US005177880A

United States Patent [19]

Preisetanz et al.

[11] Patent Number: 5,177,880

[45] Date of Patent: Jan. 12, 1993

[54] DRYER SECTION WITH INCLINED ROWS OF DRYERS

[75] Inventors: Johann Preisetanz; Wilfried Kraft; Wolfgang Mayer, all of Heidenheim, Fed. Rep. of Germany

[73] Assignee: J. M. Voith GmbH, Fed. Rep. of Germany

[21] Appl. No.: 672,392

[22] Filed: Mar. 20, 1991

[30] Foreign Application Priority Data

Dec. 22, 1990 [DE] Fed. Rep. of Germany ..... 4041493

[51] Int. Cl.[5] ..... F26B 11/02

[52] U.S. Cl. ..... 34/117; 34/115; 34/116

[58] Field of Search ..... 34/114, 115, 116, 117, 34/23, 111, 123

[56] References Cited

U.S. PATENT DOCUMENTS

| | | | |
|---|---|---|---|
| 3,355,816 | 12/1967 | McKie et al. | 34/116 |
| 4,744,156 | 5/1988 | Futcher | 34/116 |
| 4,862,600 | 9/1989 | Cremona | 34/117 |
| 4,945,655 | 8/1990 | Wedel | 34/117 |
| 4,972,608 | 11/1990 | Ilvespää | 34/115 |

*Primary Examiner*—Henry A. Bennet
*Assistant Examiner*—Denise L. F. Gromade
*Attorney, Agent, or Firm*—Ostrolenk, Faber, Gerb & Soffen

[57] ABSTRACT

A dryer section of a paper making machine is divided into several dryer groups, each comprising a plurality of dryer cylinders, a plurality of reversing rolls between neighboring cylinders and a respective web supporting belt wrapping around the cylinders of a dryer group. Within each dryer group, the web travels, in continuous contact with the supporting belt, alternately over the dryer cylinders and the reversing rolls so that the web comes into direct contact with the cylinders and the supporting belt comes into direct contact with the reversing rolls. The cylinders are arranged in several rows which are inclined to the vertical, alternately rearwardly and forwardly defining V-shaped double rows. The end of each row and the starting point of the following row are formed by two cylinders arranged horizontally alongside of each other. The rows of dryer cylinders succeed each other in the manner of a zig-zag line. Each inclined row comprises about three cylinders.

30 Claims, 4 Drawing Sheets

DRYER SECTION WITH INCLINED ROWS OF DRYERS

BACKGROUND OF THE INVENTION

The present invention relates to a dryer section for a machine for the production of fiber webs, for instance paper webs, and more particularly to the arrangement of dryer cylinders in the dryer section for shortening the structural length of the dryer section. The dryer section includes a plurality of dryer groups, and each dryer group itself comprises at least one, and more usually a plurality of dryer cylinders. Neighboring dryer cylinders in the dryer group have a respective reversing roll between them. A web supporting belt for the dryer group passes alternately over a dryer cylinder and a reversing roll moving through the dryer group in the direction of web travel. The dryer cylinders are arranged in a plurality of rows and the web travel pathway, guided by the respective web support belts in the dryer groups, is such that the web alternately passes down one row and up the next row through the dryer groups.

Such a dryer section forms the object of U.S. patent application 07/422 547, filed Nov. 28, 1989. A traditional drying section has only horizontal rows of drying cylinders. In the just mentioned patent, it was attempted to shorten the structural length of the dryer section by arranging the dryer cylinders in predominantly vertical rows. Individual dryer cylinders are shifted out of the vertical row so as to produce a row which, although it is not linear, is inclined to the vertical A forwardly inclined row is followed by a rearwardly inclined row so that the cylinder rows succeed each other in the manner of a zig-zag line.

SUMMARY OF THE INVENTION

The object of the present invention is to further develop the proposed dryer section so that it can be installed easily and can be accessible in operation and, furthermore, so that the machine frames of the section are formed of simple parts.

This object is achieved by the invention. The web to be dried is supported on one side of the respective supporting belt passing through each group. The respective supporting belt and the web thereon are so arranged that the web is in direct contact with each of the drying cylinders and the supporting belt directly contacts each of the reversing roll. Between neighboring drying groups, an appropriate transfer device is provided for transferring the web from the supporting belt of one dryer group to the supporting belt of the next dryer group in the path of the web through the dryer section.

The primary feature of the invention comprises the row of dryer cylinders being oriented so that they are generally vertical, and successive rows of dryer cylinders alternate, with one row being inclined from the vertical rearwardly and upstream in the path of the web through the dryer section and the next row being inclined from the vertical forwardly and downstream in the path of the web through the dryer section. Two adjacent oppositely inclined rows incline toward each other, with one pair of rows inclining toward each other vertically downward and the next pair of rows inclining toward each other vertically upward. Two rows inclined toward each other define a generally V-shaped double row.

Instead of there being a single dryer cylinder generally at the apex of the V, particularly in order to enable removal of break paper, the end or final dryer cylinder of which the web comes from the upstream row and the start or first dryer cylinder in the next row in the V-shaped double row are arranged horizontally alongside each other.

It is therefore preferred that all, or at least nearly all, of the rows of cylinders have the same number of cylinders, and preferably three cylinders per row. Providing three cylinders per row is already known from U.S. Pat. No. 4,744,156. In that case, however, all of the rows of cylinder are inclined in the same direction, namely all are inclined toward the rear or upstream or all toward the front or downstream This has the disadvantage that the spaces between two adjacent rows of cylinders are very narrow. In contrast to this known arrangement, the cylinders of the invention are arranged along a "rack profile". This retains the previous relatively large spaces between the rows of cylinders, which enables the temporary removal and reinstallation of an individual dryer cylinder. Furthermore, this provides space for known drying air blast and suction boxes at least at some of the reversing rolls, similarly to U.S. application Ser. No. 321,761, which is mentioned in U.S. application Ser. No. 07/467,788, filed Jan. 19, 1990. For showing of such features, the disclosures of these U.S. specifications are incorporated by reference.

Although three dryer cylinders in each row, which has a plurality of dryer cylinders, is preferred, there may be as few as two or as many as four in a multi-cylinder row. The rows of dryer cylinders usually have about the same number of dryer cylinders. At least one of the dryer groups has at least two rows. At least one of the dryer groups may have only a single row. The dryer group has a single supporting belt which passes over all of the dryers in the dryers group. Two rows forming a V-shaped double row may be in a single dryer group or may be respective parts of two successive dryer groups.

A framework of beams and posts supports the rows of dryer cylinders. Preferably, that framework includes beams and posts that support the dryer cylinders of two rows forming a V and particularly a V with its apex downward, wherein the lower cylinders are supported at a first lower plane, the upper cylinders of the two rows are supported at an upper plane and if there are central dryer cylinders between the upper and lower dryer cylinders, the central cylinders are supported at a central plane Appropriate means are provided for either articulating some of the beams or removing part of them to gain access to the particular dryer cylinders for easy replacement.

As appropriate, blast scrapers may be provided at the dryer cylinders, air blast boxes at some of the reversing rolls.

A partition wall may extend between the rows of a double row of dryer cylinders and that partition wall may include channels for feeding drying air and/or channels for removing exhaust air An air blast pipe may be provided adjacent dryer cylinders for feeding drying air to the supporting belt and into the pocket between adjacent dryer cylinders.

Other features and advantages of the present invention will become apparent from the following description of the invention which refers to the accompanying drawings.

DESCRIPTION OF THE PREFERRED EMBODIMENT

Figure 1:
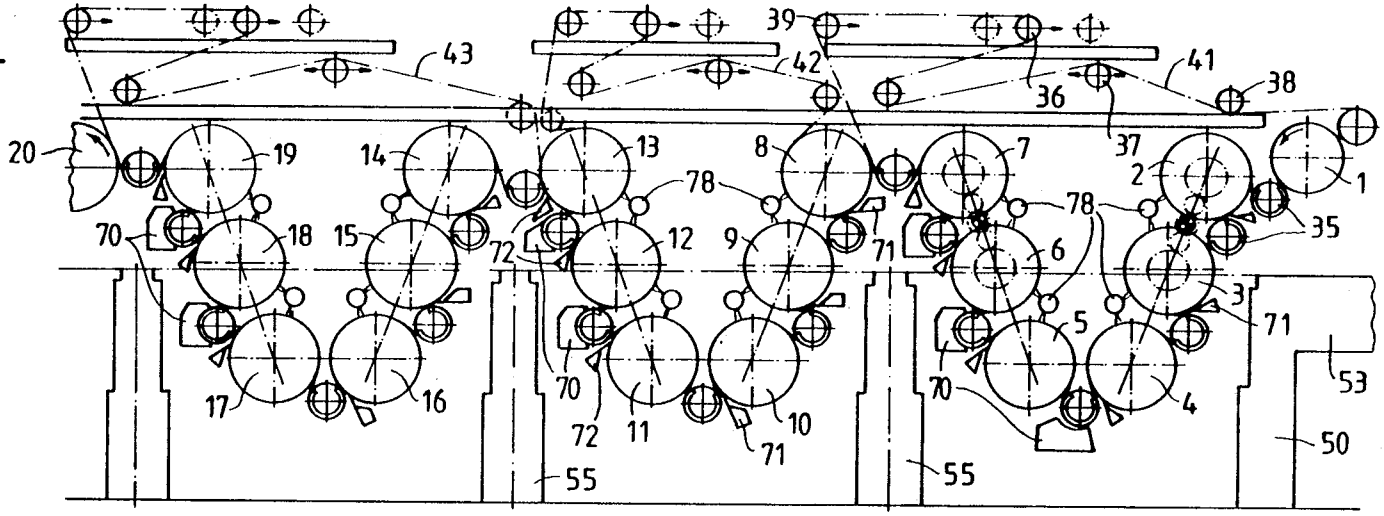
FIGS. 1 and 2 together provide a diagrammatic side view of a dryer section, FIG. 2 being a continuation of FIG. 1.
Figure 2:
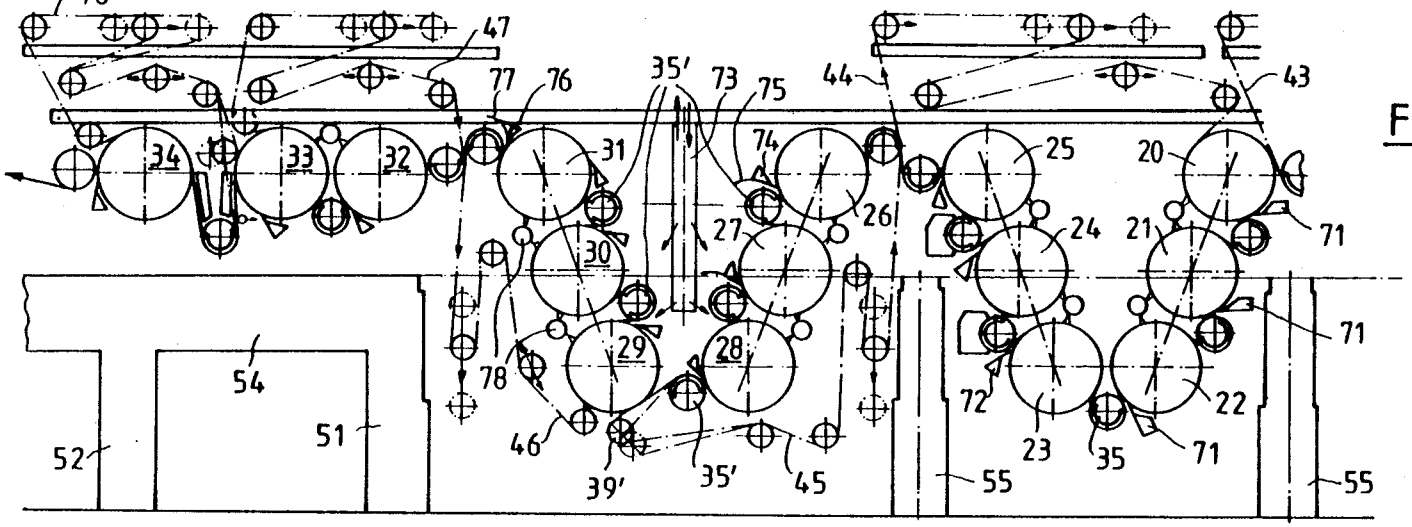

The dryer section shown in FIGS. 1 and 2 is a dryer section of a paper manufacturing machine for drying a web. The dryer section has a total of 34 heatable dryer cylinders.

A first dryer group having the first web supporting belt 41 comprises the dryer cylinders 1 to 7. Note that these dryer cylinders are in two rows inclined toward each other toward their bottom ends. This is true for most, if not all, of the other plural row dryer groups.

A second dryer group having the second web supporting belt 42 comprises the dryer cylinders 8 to 13.

A third dryer group having the third web supporting belt 43 comprises the dryer cylinders 14 to 19.

A fourth dryer group having the fourth web supporting belt 44 comprises the dryer cylinders 20 to 25.

A fifth dryer group having the fifth web supporting belt 45 comprises the dryer cylinders 26 to 28. Note that these dryer cylinders comprise only a single row.

A sixth dryer group having the sixth web supporting belt 46 comprises the dryer cylinders 29 to 31. These cylinders also comprise only a single row. The fifth and sixth groups together define a V-shaped double row of cylinders.

A seventh dryer group having the seventh web supporting belt 47 comprises the dryer cylinders 32 and 33.

An eighth (and last) dryer group having the eighth web supporting belt 48 has only one dryer cylinder 34.

Each of the supporting belts 41 to 48 is a so-called dryer wire Except for the last two dryer cylinders 33 and 34, a reversing roll 35, developed as a suction roll is arranged after or downstream of each dryer cylinder 1 to 32, and particularly between each two cylinders in each dryer cylinder group. Each reversing roll conducts its supporting belt and the web of paper adhering to the belt from the preceding dryer cylinder in the group to the following dryer cylinder therein. Within each dryer group, the paper web travels, in continuous contact with the corresponding supporting belt 41 to 48, alternately over a dryer cylinder and then over the next reversing roll. The arrangement is such that the web comes into direct contact with the dryer cylinders with the supporting belt outside the web, while the supporting belt comes into contact with the reversing rolls with the web outside the belt.

For guiding its supporting belt, each dryer group includes, in customary manner, a tensioning roll 36, a regulating roll 37 and further guide rolls 38, 39. One of the guide rolls 39 can be mounted movably. See, for example, the first dryer group having the supporting belt 41.

Most of the dryer cylinders, namely the dryer cylinders 2 to 31, are arranged in several rows lying one after the other Each row consists of three dryer cylinders As an alternative, two or four cylinders per row could also be provided. Each of the rows of cylinders extends predominantly in the vertical direction, but it is inclined to the vertical The first row 2–4 is inclined rearwardly or upstream, in the direction of web travel, the second row 5–7 is inclined forwardly or downstream in the direction of web travel, the third row 8–10 rearwardly, etc. In other words: every two consecutive inclined rows of cylinders form a V-shaped double row. As discussed elsewhere, some dryer groups include but one row, while other groups include more than one row. But, the successive rows form V-shaped double rows, with successive V's mutually inverted.

Figure 3:
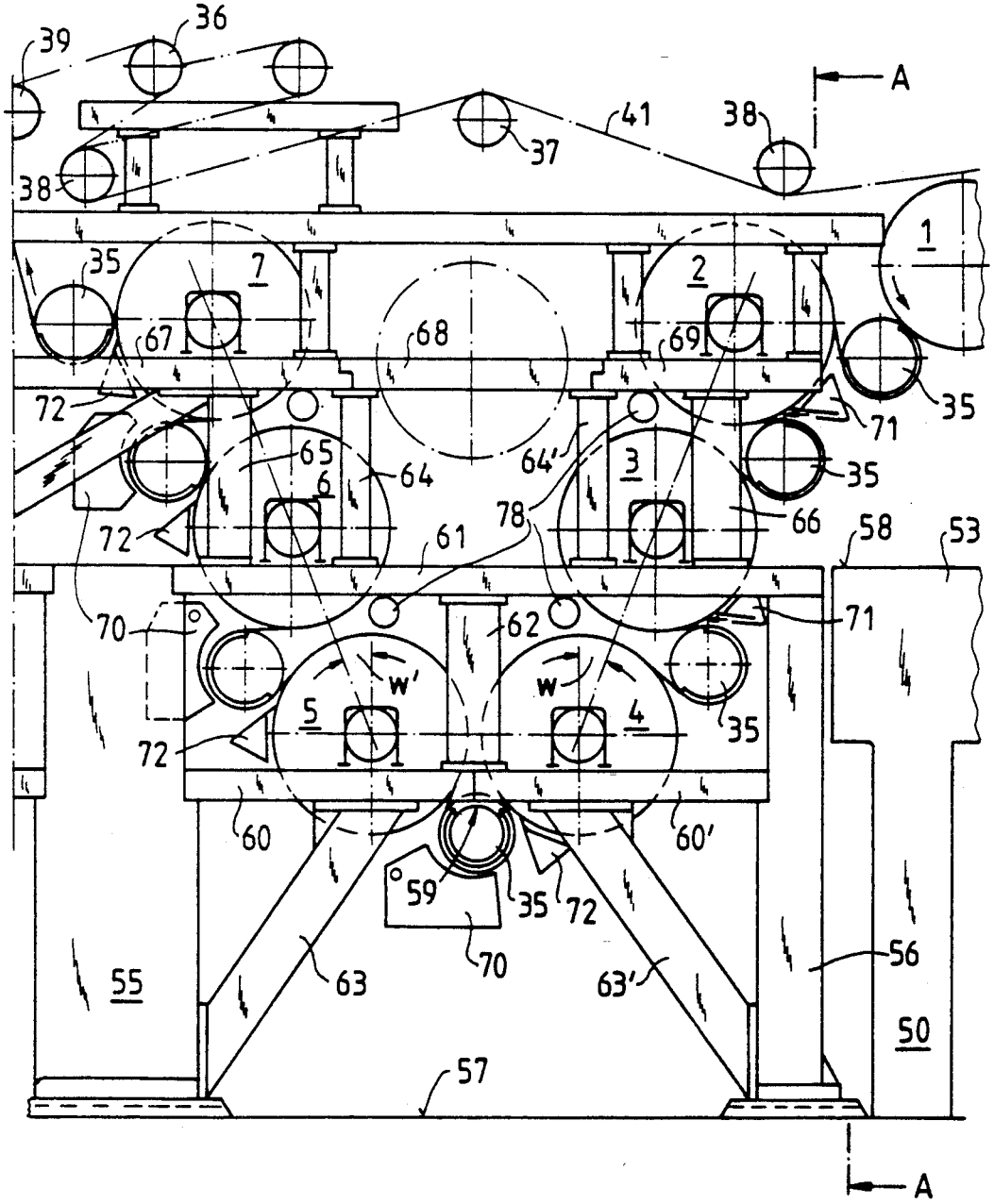
FIG. 3 is a larger scale detail from FIG. 1, also in side view.

The rearward and forward inclined angles w and w' can, as shown in FIG. 3, be the same for the rearwardly inclined and the forwardly inclined rows of cylinders, for example, between 10° and 50°. As an alternative, the angles of inclination w and w' in a double row may differ, preferably such that the angle of inclination w' of the row which is inclined forwardly is greater than the angle of inclination w of the row which is inclined rearwardly, as explained further below.

Compared with the dryer section of U.S. Ser. No. 07/422,547, wherein the cylinders and rolls are distributed and arrayed in a very tall stack, e.g., up to 15 m. tall, also having predominantly vertical rows of dryer cylinders, the arrangement according to the invention, provides an easily installed shorter height array of the cylinders which is readily accessible in operation and which the operator can easily survey because the height of the array is not excessive. Contributing to this is the fact that in each row, there are preferably three, possibly only two, but at most four cylinders arranged one above the other. Therefore, in order to further shorten the total structural height, more than four cylinders are not arranged one above the other. The selection of two or three cylinders per row enters primarily into consideration when cylinders of relatively large diameter (preferably more than 2 meters) are used.

The arrangement of the dryer cylinders is such that the end of each preceding row of cylinders and the starting cylinder of each following row of cylinders is not formed by the same single dryer cylinder, but instead by respective cylinders from the two rows, which are arranged horizontally alongside of each other. Note cylinders 4 and 5 and cylinders 7 and 8. One could thus say that the cylinders 2 to 31 are arranged one behind the other along a rack profile. One favorable consequence of this is that the number of rows of cylinders required does not become excessive and that more space is available between the rows.

In FIGS. 1 and 2, the customary concrete columns 50 to 52 and longitudinal beams 53, 54 are seen. They support the frames (not shown) for the first dryer cylinder 1 and for the three last dryer cylinders 32 to 34. Also indicated in FIGS. 1 and 2 are only a few posts 55, which may be made of concrete or of cast iron.

Figure 3A:
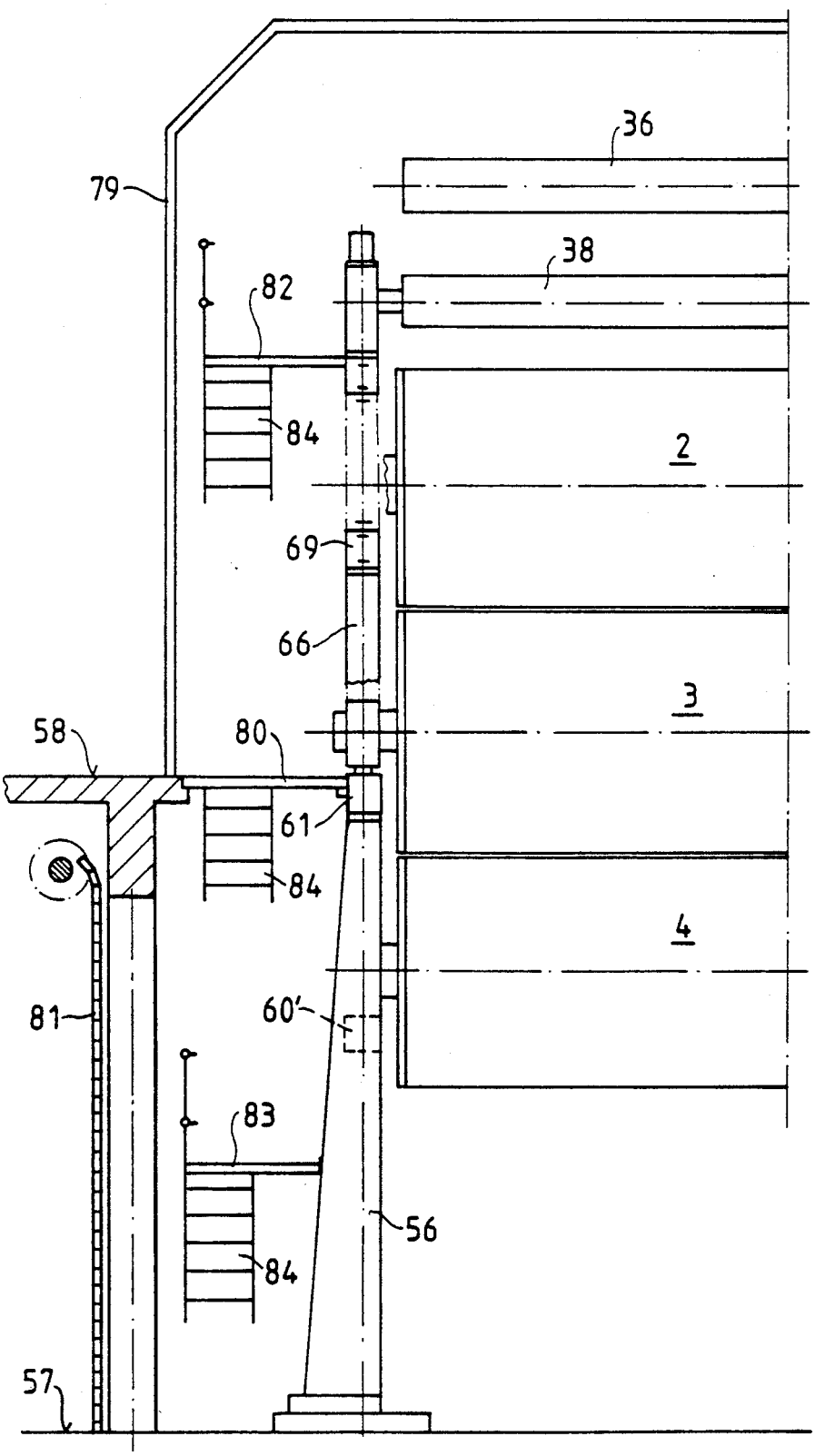
FIG. 3A is a partial cross section through the operator-side half of the dryer section, along the line A—A of FIG. 3.

FIGS. 3 and 3A are a detail of the first dryer group having the supporting belt 41, as an example. They show a preferred development of the machine frames, in part differing from FIG. 1. One of the posts 55 is seen and, differing from FIG. 1, a post 56, which is provided in addition to the concrete column 50. Both posts 55 and 56 extend from the cellar floor 57 up to approximately the height of the floor of the paper machine 58. A two part lower longitudinal beam 60, 60' and a central longitudinal beam 61 rest on the two posts 55 and 56. The lower longitudinal beam is divided by a transverse joint 59 into two halves 60 and 60'. The beam halves are connected to the central longitudinal beam 61 by a common vertical column 62 and are furthermore supported in each case by a diagonal beam 63, 63'.

FIG. 3A shows that between the customary concrete paper machine floor 58 and the central longitudinal beam 61, there is a larger distance which is bridged over by a grate 80. This makes it possible for exhaust air to rise upward from the cellar alongside of the paper machine. The hood 79 which rests on the paper machine floor 58 is diagrammatically indicated, as are a rolling lift gate 81 which delimits the cellar on the side, an upper foot bridge 82 and a lower foot bridge 83, as well as several connecting steps 84.

On the central longitudinal beam 61 there are two main posts 65 and 66, as well as two auxiliary posts 64, 64'. On these parts rests an upper, multi-part longitudinal beam 67, 68, 69. On the lower longitudinal beam 60, 60', the two lower cylinders 4 and 5 are supported in a lower plane. The central cylinders 3 and 6 are supported on the central longitudinal beam 61 in a central plane. The upper cylinders 2 and 7 are supported on the upper longitudinal beam 67, 68, 69 in a upper plane. Further columns and longitudinal beams, without reference numerals, for the guide rolls 36, 39 are located on the upper longitudinal beams 67, 68, 69.

If one of the lower cylinders, for instance the cylinder 4, must be temporarily removed from the machine, the frame parts 60' and 63' are temporarily removed. If one of the central cylinders 3 or 6 must be temporarily removed, then the central part 68 of the upper longitudinal beam and the auxiliary column 64 or 64' near the respective central cylinder are removed. The removed cylinder is then brought into the position indicated by the dot-dash circle and from there it is removed laterally out of the machine.

As can be noted from FIGS. 1 and 2, the first dryer group having the first supporting belt 41 comprises, in addition to the first cylinder 1, two successive inclined rows of cylinders which form a V-shaped double row. Within the first dryer group, the bottom of the web comes into contact with the cylinders 1 to 7. Accordingly, the reversing rolls 35 lie predominantly below the space between the respective dryer cylinders adjacent each reversing roll or, more accurately, on the outside of the V formed by the rows of cylinders. This is favorable for the removal of any break paper which may be produced, since the break paper can simply fall downward from the reversing rolls onto the floor 57 of the cellar. The second, third and fourth dryer groups, having the respective supporting belts 42, 43 and 44, have the same features in accordance with FIGS. 1 and 2.

Accordingly, the transfer of the web of paper from the first to the second dryer groups and from the third to the fourth dryer groups takes place as follows: The supporting belt, for instance 41, of the preceding first dryer group is tangent to the first dryer cylinder 8 of the following second dryer group and transfers the web of paper to the cylinder 8. An alternative to this is shown between the cylinders 13 and 14. Here, the supporting belt 43 of the following third dryer group is tangent to the last cylinder 13 of the preceding second dryer group in order to remove the web of paper from the cylinder 13. No turning over of the web of paper takes place at any of these transfer points. Instead in all of the dryer groups having the supporting belts 41 to 44, the same side of the web, namely its bottom side, comes into contact with the respective dryer cylinders. This is possible in the manufacture of papers of not too high quality. Other arrangements are described further below.

In FIG. 2, still another V-shaped double row is provided with the cylinders 26 to 31. Differing from the preceding double rows, these rows form two dryer groups, independent of each other, each having the respective supporting belts 45 and 46, and there is a transfer place for the web from the supporting belt 45 to the cylinder 29. Between the cylinders 25 and 26, there is provided a known turn-transfer point where the web shifts from the supporting belt 44 to the supporting belt 45. This causes the top side of the web to come into direct contact with the cylinders 26 to 31 in the double rows having the supporting belts 45 and 46. In the latter rows, the reversing rolls 35' lie predominantly above the spaces between the respective adjacent dryer cylinders or, stated more precisely, on the inside of the V formed by the rows of cylinders. In order that any break paper produced can still be discharged downward, the guide roll 39' provided at the cylinder 29 for the supporting belt 45 is swingably mounted. This guide roll 39' can be moved away from the cylinder 29 into the position shown in dot-dash lines so that an open slot is produced between the cylinder 29 and the supporting belt 45.

In the center of the V-shaped double row having the cylinders 26 to 31, there is a partition wall 73, which extends from above between the two rows of cylinders. The partition wall 73 serves, on the one hand, to deflect break paper downward. On the other hand, channels can be provided in the partition wall 73 in order to feed drying air to the web of paper, primarily in the region of the reversing rolls 35'. The emerging drying air can then, in addition, assist in the transport of break paper downward. Further, channels can be provided in the partition wall 73 for discharge of exhaust air, like steam vapor and/or drying air which has absorbed water vapor. The streams of drying air and of exhaust air are indicated by arrows. Furthermore, on the cylinders 26, 27, 30 and 31 there can be specially shaped scrapers 74 which each have a guide plate 75, again for deflecting any break paper which is produced. A similar construction is provided in the case of an edge strip scraper 76 on the cylinder 31 on which a guide plate 77 is provided for deflecting the edge strip. In this way the threading of the edge strip into the dryer section can be facilitated.

Throughout the entire dryer section, a dry air blast tube 78 can be arranged between every two adjacent dryer cylinders for feeding drying air into the regions of the dryer cylinders which are covered by the web and the supporting belt and for feeding drying air into the pocket present between every two cylinders.

Referring again to FIG. 3, known blast boxes 70 are arranged on some of the reversing rolls 35, and particularly on the three reversing rolls which are between dryer cylinders 4 and 7. They serve to feed drying air to the web of paper and preferably also remove water vapor and drying air which has taken on water vapor. At the other reversing rolls 35, namely between the cylinders 2 and 4, no drying air blast boxes are provided since they would prevent the removal downward there of any break paper that is possibly produced. Therefore, special scrapers 71 are provided on the cylinders 2 and 3, which serve in known manner also for feeding drying air, as indicated by an arrow. Ordinary scrapers 72 are provided on the other cylinders 4 to 7. However, on the cylinders 6 and 7, each of the scrapers 72 at least approximately covers the respective blast box 70 located below it. In other words, each of the blast boxes 70 lies in the "shadow" of the scrapers 72 lying above it. In this way, the break paper which may accumulate at the scraper 72 can fall downward past the blast boxes 70. If space is to be provided for still larger blast boxes, the angle of inclination w' of the row of cylinders 5–7 is made greater than the angle of inclination w of the row of cylinders 2–4.

Figure 4:
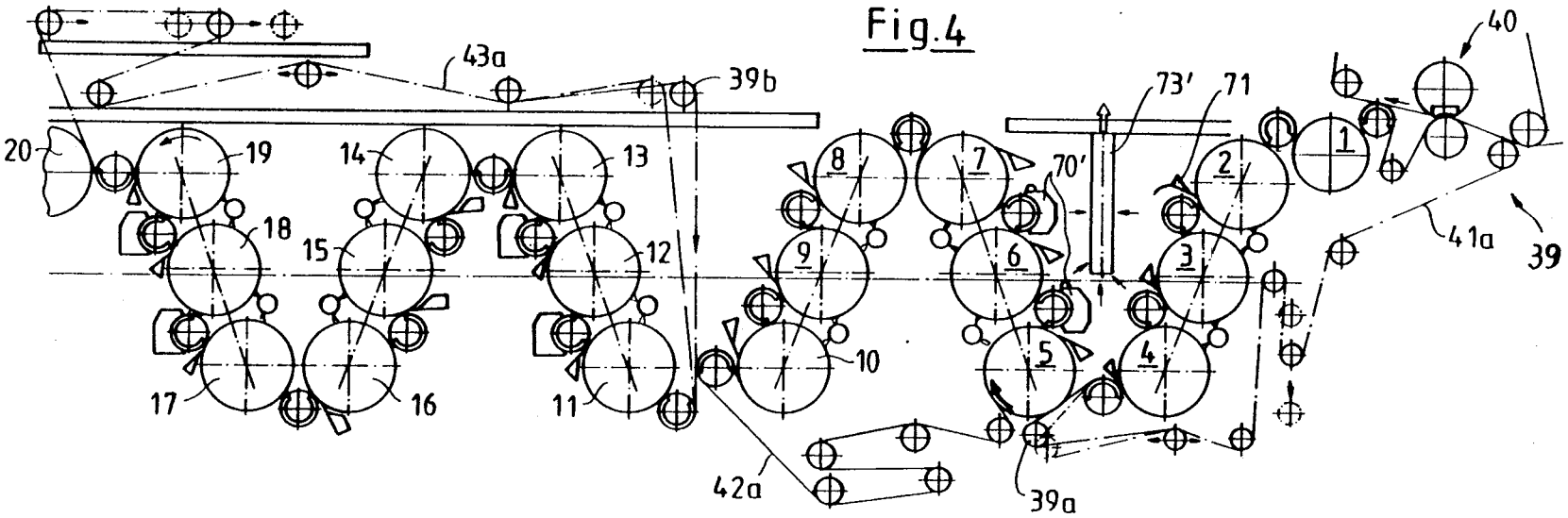
FIGS. 4 and 5 are diagrammatic side views of two different alternatives for the dryer section of FIG. 1.

FIG. 4 differs from FIG. 1. The first group of dryers comprises only the cylinders 1 to 4 and has a first web supporting belt 41*a*. This supporting belt is developed as a felt and extends also through a nip 40 in the press section 39. The belt serves there in known manner as a water removal felt. The cylinders 5 to 10 together form a second group of dryers with the second supporting belt 42*a*. The first supporting belt 41*a* transfers the web of paper, without turning, to the cylinder 5. On all of the cylinders 1 to 10, the top side of the web comes into direct contact with the cylinders. Accordingly, the reversing rolls 35*a* lie predominantly above the space between the respective adjacent dryer cylinders. The dryer cylinders 11 to 19 in three rows together form a third dryer group with the third supporting belt 43*a*. Here, the bottom side of the web comes into direct contact with the dryer cylinders so that the reversing rolls 35 are arranged predominantly below the space between the respective adjacent dryer cylinders. Between the cylinders 10 and 11 there is a turn transfer point. The removal of any break paper from the cylinders 1 to 10 is facilitated by the formation of open slots by means of the moveable guide rolls 39*a*, 39*b*.

Figure 5:
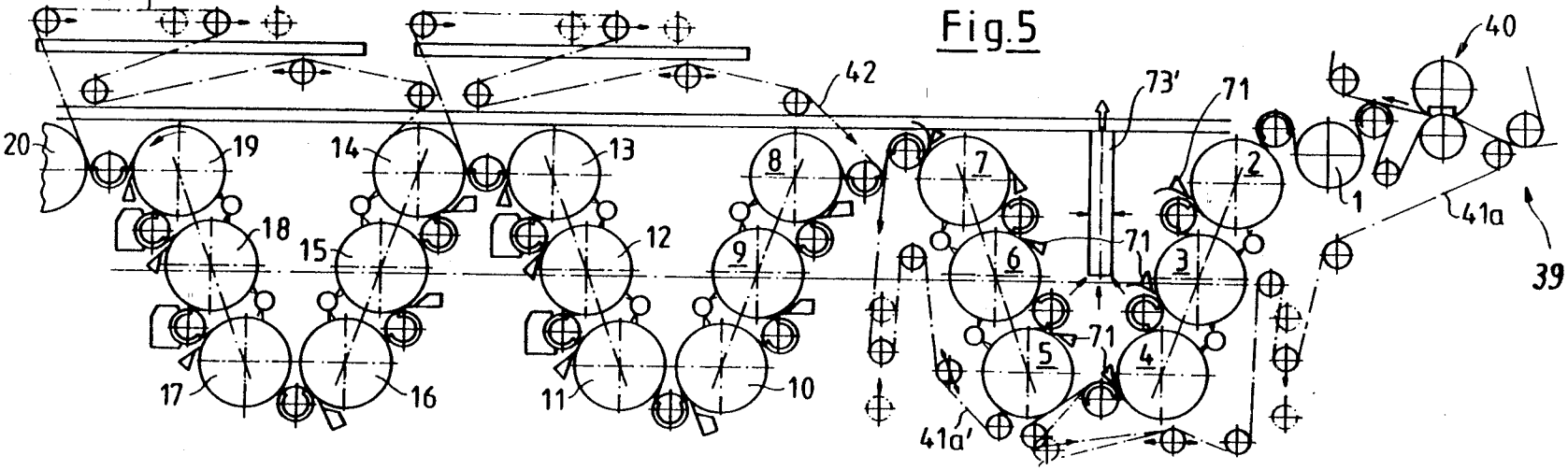

In the alternate embodiment of FIG. 5 the first dryer group having the cylinders 1 to 4 is developed in the same manner as in FIG. 4. The second dryer group now differs from FIG. 4 and comprises only a single row of cylinders 5 to 7. This is followed by a turn-transfer point from the second supporting belt 41*a*' to the third supporting belt 42 of the following dryer group. Their construction corresponds precisely to that of the second dryer group of FIG. 1. Thus FIG. 5 differs from FIG. 1, among other things, by the fact that the first dryer group of FIG. 1, having the first supporting belt 41, is divided into two dryer groups of FIG. 5. As compared with FIG. 1, in the embodiments of FIGS. 4 and 5, there is a somewhat more frequent change of the sides of the web that comes into contact with the dryer cylinders. This change over is desirable for drying of better quality papers.

Finally, FIGS. 4 and 5 show that in the first V-shaped double row (cylinders 2 to 7) there is again a partition wall 73'. This wall has only exhaust-air suction channels, differing from the partition wall 73 of FIG. 2, since, in accordance with FIG. 4, drying air blast boxes 70' are provided, and in accordance with FIG. 5 and in part also in FIG. 4, drying air blast scrapers 71 are provided.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dryer section for a machine for manufacturing fiber webs, the dryer section comprising:

a plurality of dryer groups arranged one after another in a path of the web through the dryer section; at least some of the dryer groups comprising a plurality of dryer cylinders;

in those dryer groups comprising a plurality of dryer cylinders a respective reversing roll located between two of the dryer cylinders;

a respective supporting belt for each dryer group, the belt alternately passing over a dryer cylinder and over a reversing roll between two neighboring dryer cylinders, the supporting belt having one side on which the belt supports the web so that the web remains in continuous contact with the supporting belt moving through the dryer group and the web passes with the supporting belt over the dryer cylinders and the reversing rolls in the dryer group, the supporting belt being so arranged in the dryer group that the web on the one side of the supporting belt comes into direct contact with the dryer cylinders in the dryer group and the supporting belt comes into direct contact with the reversing rolls in the group;

the dryer cylinders through the dryer groups being arranged in a plurality of rows so that the web alternately passes down one inclined row and up the next inclined row through the dryer groups; successive rows of dryer cylinders alternating, with one row being inclined from the vertical rearwardly and upstream in the path of the web through the dryer section and the next row being inclined from the vertical forwardly and downstream in the path of the web through the dryer section, whereby each two adjacent oppositely inclined rows incline toward each other, such that the row that is upstream in the path of the web through the dryer section has an end dryer cylinder off which the web comes before moving to the next downstream row, and the next row having a respective starting dryer cylinder which is the next dryer cylinder that the web contacts after leaving the end dryer cylinder of the next upstream row, the end dryer cylinder of each row and the starting dryer cylinder of the next downstream row of dryer cylinders being arranged horizontally alongside each other and two of the rows are respective successive pairs of the inclined rows being so inclined that lower dryer cylinders thereof are nearer open another along a lower plane and the upper dryer cylinders thereof are spaced further apart along an upper plane.

2. The dryer section of claim 1, wherein at least some of the dryer groups include more than one of the inclined rows of dryer cylinders therein, and each dryer group has the respective support belt thereof passing over all of the dryer cylinders of that dryer group.

3. The dryer section of claim 1, wherein substantially all of the rows of dryer cylinders have the same number of dryer cylinders.

4. The dryer section of claim 3, wherein one of the dryer groups has one inclined row of the dryer cylinders therein and another of the dryer groups has more than one of the inclined rows of dryer cylinders therein, and each dryer group has the respective support belt thereof passing over all of the dryer cylinders of that dryer group.

5. The dryer section of claim 3, wherein there are between two and four dryer cylinders in each of the rows.

6. The dryer section of claim 3, wherein there are three of the dryer cylinders in each of the rows.

7. The dryer section of claim 3, wherein there are about three cylinders in each of the rows.

8. The dryer section of claim 7, wherein each of the dryer cylinders has a diameter of at least two meters.

9. The dryer section of claim 7, wherein each of the rows of dryer cylinders comprises an upper cylinder that is vertically higher ,and a lower cylinder that is vertically lower;

the dryer section further comprising a frame for supporting the dryer cylinders; the frame having an upper plane and the upper dryer cylinders of all of the rows being arranged on the upper plane; the frame having a lower plane beneath the upper plane, and the lower dryer cylinders of all the rows being arranged on the lower plane of the frame.

10. The dryer section of claim 9, wherein at least some of the rows of dryer cylinders including a central cylinder vertically between the upper and lower cylinders;

the frame having a central plane between the upper and the lower planes and the central dryer cylinders are arranged on the central plane of the frame.

11. The dryer section of claim 10, wherein the machine for manufacturing the fiber webs has a floor and the central plane of the frame lies at least approximately at the height of the floor of the machine.

12. The dryer section of claim 10, wherein each two successive inclined rows of dryer cylinders define a generally V-shaped double row of dryer cylinders;

the frame of the machine comprises two first vertical posts which extends up to approximately the height of the frame central plane and are spaced apart a distance greater than the distance along the central plane between the central cylinders of the two successive rows;

a lower longitudinal beam beneath the central plane for supporting the lower dryer cylinders of the two rows;

a central longitudinal beam resting on the vertical posts for supporting the central drying cylinders of the two rows;

additional posts on the central beam and an upper longitudinal beam on the additional posts for supporting the upper cylinders of the two rows.

13. The dryer section of claim 12, wherein the upper longitudinal beam has a central part between the upper dryer cylinders in the two successive rows, and the central part is removable from the upper longitudinal beam, the central part being of a size large enough that the space produced by its removal enables introduction and removal of a dryer cylinder past the area in the upper longitudinal beam from which the central part was removed.

14. The dryer section of claim 12, further comprising the lower longitudinal beam being divided and a transverse joint in the lower longitudinal beam between the divided sections thereof; a vertical post between the divided parts of the lower longitudinal beam and the central longitudinal beam.

15. The dryer section of claim 2, wherein the the supporting belt so passes the dryer cylinders and the reversing rolls of the rows and the web is so supported on the supporting belts that the bottom side of the web contacts the dryer cylinders at least one of the double rows of the drying cylinders, and the reversing rolls on the double row lie predominately below the space between the respective dryer cylinders between which the reversing rolls are disposed.

16. The dryer section of claim 2, wherein the dryer groups in the dryer section are in a sequence, the first of the dryer groups in the sequence comprises a generally V-shaped double row of dryer cylinders;

a respective one of the reversing rolls is disposed between each two of the dryer cylinders in each row;

the dryer cylinders and the reversing rolls of the first group being so positioned and the supporting belt passing over the dryer cylinders and the reversing rolls of the first dryer group and the web being on the side of the supporting belt such that the bottom side of the web contacts the dryer cylinders.

17. The dryer section of claim 16, wherein at least one other of the dryer groups comprises a generally V-shaped double row of dryer cylinders;

a respective one of the reversing rolls is disposed between each two of the dryer cylinders in each row;

the dryer cylinders and the reversing rolls of the second dryer group being so positioned and the supporting belt of the second dryer group so passing thereover and the web being on the side of the second supporting belt such that the bottom side of the web also contacts the dryer cylinders of the second dryer group.

18. The dryer section of claim 2, wherein two successive rows of the dryer cylinders define a general V-shaped double row, and each of the two rows of the V-shaped double row of dryer cylinders belongs to two successive dryer groups in the dryer section, with each of the two dryer groups being provided with its respective supporting belt passing over the dryer cylinders of the respective dryer groups; and a device for transferring the web from the first of the successive dryer groups to the second of the successive dryer groups, and the transfer device being positioned at the end dryer cylinder of the first group and the starting dryer cylinder of the second group.

19. The dryer section of claim 15, further comprising blast scrapers at the dryer cylinders in the first of the rearwardly inclined row, and the reversing rolls of the first row being free of drying air blast boxes;

in the second, forwardly inclined row of dryer cylinders, drying air blast boxes are provided at the reversing rolls thereof.

20. The dryer section of claim 19, further comprising a respective scraper above the blast boxes at the reversing rolls in the second dryer group, the scraper resting against the next following dryer cylinder in the row during the path of web travel and the scraper is shaped to at least approximately cover the respective blast box.

21. The dryer section of claim 2, wherein each of the rows of dryer cylinders comprises an upper cylinder that is vertically higher and a lower cylinder that is vertically lower;

the supporting belt so passes the dryer cylinders and the reversing rolls of the rows and the web is so supported on the supporting belts that the top side of the web contacts the drying cylinders and the respective reversing rolls in the double row lie predominately above the space between the respective dryer cylinders between which the reversing rolls are disposed.

22. The dryer section of claim 21, further comprising a partition wall extending between the two rows of cylinders of the V-shaped double row from above;

for defining a parting place between the two lower cylinders of two adjacent rows which are in respective dryer groups, a device for transferring the web from the preceding row in one dryer group in the path of the web through the dryer section to the following row in the successive dryer group in the dryer section; and a guide roll movably supported at the place of transfer of the web between the dryer groups, the guide roll being movable for defining a slot between the dryer groups for enabling the removal of break paper between the lower dryer cylinders of the two groups.

23. The dryer section of claim 22, further comprising channels in the partition wall for feeding drying air.

24. The dryer section of claim 23, further comprising further channels in the partition wall for the removal of exhaust air from the dryer section.

25. The dryer section of claim 22, further comprising at least one of the dryer cylinders, the scraper including a guide plate for downwardly deflecting any break paper produced.

26. The dryer section of claim 2, further comprising a drying air blast pipe between pairs of adjacent dryer cylinders in various of the dryer cylinder rows for feeding drying air to the respective supporting belt for that drying group and into the pocket defined between the adjacent dryer cylinders.

27. The dryer section of claim 2, wherein each two successive inclined rows of dryer cylinders define a generally V-shaped double row of dryer cylinders;

the two rows of dryer cylinders comprises an upper cylinder that is vertically higher and a lower cylinder that is vertically lower;

the dryer section further comprising a frame for supporting the dryer cylinders; the frame having an upper plane and the upper dryer cylinders of all of the rows being arranged on the upper plane; the frame having a lower plane beneath the upper plane, and the lower dryer cylinders of all the rows being arranged on the lower plane of the frame;

the two rows of dryer cylinders including a central cylinder vertically between the upper and lower cylinders;

the frame having a central plane between the upper and the lower planes and the cylinders have a central dryer cylinders are arranged on the central plane of the frame.

28. The dryer section of claim 1, wherein each of the inclined rows of dryer cylinders is an essentially straight inclined row between the top dryer cylinder and the bottom dryer cylinder of the row.

29. A dryer section for a machine for manufacturing fiber webs, the dryer section comprising:

a plurality of dryer groups arranged one after another in a path of the web through the dryer section; at least some of the dryer groups comprising a plurality of dryer cylinders;

a respective supporting belt for each dryer group, the supporting belt having one side on which the belt supports the web so that the web remains in continuous contact with the supporting belt moving through the dryer group over the dryer cylinders in the dryer group, the supporting belt being arranged so that the web on the one side of the supporting belt comes into direct contact with the dryer cylinders in the dryer group;

the dryer cylinders through the dryer groups being arranged in a plurality of rows so that the web alternately passes down one inclined row and up the next inclined row through the dryer groups; successive rows of dryer cylinders alternating, with one row being inclined from the vertical rearwardly and upstream in the path of the web through the dryer section and the next row being inclined from the vertical forwardly and downstream in the path of the web through the dryer section, whereby each two adjacent oppositely inclined rows incline toward each other, such that the row that is upstream in the path of the web through the dryer section has an end dryer cylinder off which the web comes before moving to the next downstream row, and the next row having a respective starting dryer cylinder which is the next dryer cylinder that the web contacts after leaving the end dryer cylinder of the next upstream row and two of the rows are respective successive pairs of the inclined rows being so inclined that lower dryer cylinders thereof are nearer one another along a lower plane and the upper dryer cylinders thereof are spaced further apart along an upper plane.

30. The dryer section of claim 29, wherein each of the inclined rows of dryer cylinders is an essentially straight inclined row between the top dryer cylinder and the bottom dryer cylinder of the row.

* * * * *